US005652520A

United States Patent [19]

Kawamoto et al.

[11] Patent Number: 5,652,520

[45] Date of Patent: Jul. 29, 1997

[54] INTERNAL COMBUSTION ENGINE MISFIRE CIRCUIT USING ION CURRENT SENSING

[75] Inventors: Atsunobu Kawamoto; Yukio Yasuda, both of Tokyo, Japan

[73] Assignee: Mitsubishi Denki Kabushiki Kaisha, Tokyo, Japan

[21] Appl. No.: 554,717

[22] Filed: Nov. 7, 1995

[30] Foreign Application Priority Data

Nov. 9, 1994 [JP] Japan ..... 6-274942

[51] Int. Cl.[6] ..... F02P 17/00

[52] U.S. Cl. ..... 324/388; 324/399; 324/402; 73/116

[58] Field of Search ..... 324/378, 388, 324/393, 399, 402; 73/116, 117.3; 123/425, 479, 630, 650, 656

[56] References Cited

U.S. PATENT DOCUMENTS

| | | | |
|---|---|---|---|
| 5,321,978 | 6/1994 | Brandt et al. | 73/116 |
| 5,392,641 | 2/1995 | McCombie | 73/117.3 |
| 5,396,176 | 3/1995 | Ishii et al. | 324/388 |
| 5,397,990 | 3/1995 | Ohsawa | 324/399 |
| 5,424,647 | 6/1995 | Ohsawa et al. | 324/399 X |
| 5,483,818 | 1/1996 | Brandt et al. | 324/399 X |
| 5,548,220 | 8/1996 | Kawamoto et al. | 324/399 |
| 5,561,239 | 10/1996 | Yasuda | 324/399 X |
| 5,563,332 | 10/1996 | Yasuda | 324/399 X |

FOREIGN PATENT DOCUMENTS 7217519 8/1995 Japan .

*Primary Examiner*—Vinh P. Nguyen
*Assistant Examiner*—Diep Do
*Attorney, Agent, or Firm*—Leydig, Voit & Mayer

[57] ABSTRACT

An internal combustion engine misfire sensing circuit comprises an ion current sensing circuit for sensing an ion current in the combustion chamber of an internal combustion engine, a current/voltage conversion circuit for converting the sensed ion current into a voltage and a waveform shaping circuit for shaping the waveform of an output of the current/voltage conversion circuit. The waveform shaping circuit includes a second comparator for comparing a voltage of a third capacitor with first and second reference voltages for outputting a misfire sensing signal and a capacitor charging/discharging circuit for charging the third capacitor in response to the rising up of an output of the current/voltage conversion circuit and discharging the third capacitor based on the input of the misfire sensing signal. With this arrangement a misfire can be sensed even in an internal combustion engine having multiple cylinders, the number of parts can be reduced as well as the area of circuits can be reduced.

7 Claims, 7 Drawing Sheets

INTERNAL COMBUSTION ENGINE MISFIRE CIRCUIT USING ION CURRENT SENSING

BACKGROUND OF THE INVENTION

1. Field of the Invention

The present invention relates to an internal combustion engine misfire sensing circuit for sensing misfire by sensing an ion current in the combustion chamber of an internal combustion engine.

2. Description of the Related Art

When combustion is carried out in the combustion chamber of an internal combustion engine, the molecules of a mixture of air and fuel in the combustion chamber are ionized during combustion. When a voltage is applied to the combustion chamber in the ionized state through ignition plugs, a fine current called an "ion current" flows. Since the ion current is made very small when misfire occurs, the occurrence of the misfire can be determined by sensing this ion current.

As shown in the specification of Japanese Patent Application No. 6-8880 as an earlier application which is not yet published (filing date: Jan. 28, 1994), an example of an internal combustion engine misfire sensing circuit is arranged such that an ion current is converted into a voltage, and when the converted voltage exceeds a predetermined threshold value, it is determined that ignition is carried out, whereas when the voltage does not exceed the threshold value, it is determined that a misfire occurred and a two-value signal corresponding to the determination is output.

The known internal combustion engine misfire sensing circuit will be described with reference to FIG. 5, FIG. 6 and FIG. 7. FIG. 5 is a view showing an arrangement of a known internal combustion engine, FIG. 6 is a diagram showing an arrangement of a known internal combustion engine misfire sensing circuit, and FIG. 7 is a timing chart showing the operation of the known internal combustion engine misfire sensing circuit. Note, FIG. 7 shows the respective signals of two internal combustion engine misfire sensing circuits.

In FIG. 5, a known eight-cylinder (#1–#8) internal combustion engine includes ignition coils 2 (**2*a*–2*h*), ignition plugs 3 (3*a*–3*h*) connected to the secondary negative poles of the ignition coils 2 and disposed in the combustion chamber, a power supply 4 connected to the positive poles of the primary coils of the ignition coils 2 and current switching transistors 5 (5*a*–5*h***) having collectors connected to the negative poles of the primary coils.

In FIG. 5, each of the transistors 5 has an emitter connected to the ground and a base connected to a combustion controller (not shown). Note, a known internal combustion engine misfire sensing circuit **1*a* is connected to the ignition coils 2*a*, 2*c*, 2*e* and 2*g* of cylinders #1, #3, #5 and #7 and a known internal combustion engine misfire sensing circuit 1*b* is connected to the ignition coils 2*b*, 2*d*, 2*f* and 2*h* of cylinders #2, #4, #6 and #8**.

In FIG. 6, each of the internal combustion engine misfire sensing circuits 1 (**1*a*, 1*b*) is composed of an ion current sensing circuit 7 for imposing a positive polar voltage on the ignition plugs 3 in the combustion chamber 6 and sensing a negative polar ion current produced by combustion, a current/voltage conversion circuit 8 for converting the negative polar ion current into a positive polar voltage and a waveform shaping circuit 9 for shaping the waveform of an output from the current/voltage conversion circuit 8**.

As shown in FIG. 7, when ignition is effected in the internal combustion engine, each transistor 5 is abruptly switched from an ON state to an OFF state in response to a control signal S from the combustion controller. A primary current in each ignition coil 2 is abruptly reduced at the time and a high voltage is generated by a back electromotive force of each ignition coil 2. A voltage generated on the primary coil of each ignition coil is boosted on the secondary coil thereof in accordance with the ratio of windings of the secondary coil to those of the primary coil and appears to the secondary coil of each ignition coil. As a result, a high voltage S2 of about −30 kV is imposed on the ignition plugs 3 as shown in FIG. 7. Note, FIG. 7 shows the signals S1, S2 of cylinders #1, #3 connected to the internal combustion engine misfire sensing circuit **1*a* and the signals S1, S2 of cylinders #2, #4 connected to the internal combustion engine misfire sensing circuit 1*b*** and omits the signals of the other cylinders.

The ion current sensing circuit 7 accumulates an electric charge in a capacitor 11 which is sufficient to sense an ion current, making use of energy obtained at the time of ignition and senses the ion current by a voltage supplied from the capacitor 11 immediately after the occurrence of the ignition. A current, at the time of the ignition, flows in the direction of arrow **3*a* in FIG. 6, causes discharging at the ignition plugs 3 and fires the mixed gas in the combustion chamber 6. Then, the discharged current charges the capacitor 11 to a voltage limited by a Zener diode 10**.

When the ignition current in the direction of arrow **3*a* is reduced to zero, the voltage held by the capacitor 11 is imposed on the ignition plugs 3. When combustion is normally effected in the combustion chamber 6 at the time, the ion current flows in the direction of arrow 3*b***.

A voltage at the point where the capacitor 11 is connected to a diode 12, i.e. a voltage output from the ion current sensing circuit 7 is a voltage at the inverting input of an inverting amplifier comprising of an operational amplifier 14 and a feedback resistor 15. When the operational amplifier 14 normally operates, the voltage becomes zero volt which is equal to a non-inverting input voltage. There are two types of cases in which the operational amplifier 14 does not normally operate, that is, they are a case in which a current flows in the direction of arrow **3*a* and a case in which an excessively large current flows in the direction of arrow 3*b* and an output from the operational amplifier 14** is saturated.

When a current flows in the direction of arrow **3*a*, a voltage output from the ion current sensing circuit 7 is used as a forward voltage (e.g. 0.7 V) of the diode 12, whereas when a large current flows in the direction of arrow 3*b* and the an output from the operational amplifier 14 is saturated, a diode 13 is conducted to thereby achieve a voltage reduced by an amount of the forward voltage. When the operational amplifier 14 normally operates, the ion current appears as a voltage drop across the feedback resistor 15 and is converted into a ground reference signal S4 as shown in FIG. 7. Note, in the signals S4 of FIG. 7, a ground reference signal from the internal combustion engine misfire sensing circuit 1*a*** is represented by S4*a* and a ground reference signal from the internal combustion engine misfire sensing circuit **1*b*** is represented by S4*b*. Subsequent signals S6 and S7 are also represented in the same manner.

As shown in FIG. 6, a leak current compensation feedback circuit 17 which is connected to the rear stage of the current/voltage conversion circuit 8 comprises a comparator 19 for comparing an output from the operational amplifier 14 with a threshold voltage of a reference voltage source 18, a capacitor 20 and a constant current charging/discharging circuit 21 of the capacitor 20. The leak current compensation feedback circuit 17 controls the output from the operational amplifier 14 so that it does not exceed the threshold voltage of the reference voltage source 18.

The waveform shaping circuit 9 comprises the comparator 19 for comparing the output from the operational amplifier 14 with the threshold voltage of the reference voltage source 18, a capacitor 22, a constant current charging/discharging circuit 23 of the capacitor 22 and a comparator 25 for comparing a voltage of the capacitor 22 with a threshold voltage of a reference voltage source 24. That is, the comparator 19 is shared by the current/voltage conversion circuit 8 and the waveform shaping circuit 9.

When the ion current is generated and the voltage output from the operational amplifier 14 is boosted and exceeds the threshold voltage of the reference voltage source 18, the capacitor 20 is charged and its voltage is boosted and a feedback current is increased. During the period in which the ion current is generated, a voltage output from the comparator 19 is increased to a high level, whereby the capacitor 22 of the waveform shaping circuit 9 is charged and its voltage S6 is boosted as shown in S6 of FIG. 7. When the voltage S6 of the capacitor 22 exceeds the threshold voltage of the reference voltage source 24, a misfire sensing signal S7 as an output from the comparator 25 is made to a high level as shown in S7 of FIG. 7. The waveform shaping circuit 9 filtrates and outputs an ion current enduring for a predetermined period of time and removes an ion current caused by a leak current.

A four-cylinder engine has, for example, an ignition cycle of 5 ms at 1000 rpm, whereas an engine having the greater number of cylinders such as eight cylinders has a shorter ignition cycle of 2.5 ms at the same 1000 rpm. On the other hand, an ion current flows for about 2.5 ms after the occurrence of ignition. Therefore, when combustion intervals are close to each other as in the case of the eight-cylinder engine, since periods during which the ion current flows overlap, the known internal combustion engine misfire sensing circuit cannot sense the misfire of the eight-cylinder engine.

To cope with this problem, the known internal combustion engine misfire sensing circuit divides the cylinders into two groups to make combustion intervals coarse and employs the two sets of the internal combustion engine misfire sensing circuits 1*a* and 1*b*. That is, as shown in S7 of FIG. 7, the internal combustion engine misfire sensing circuit 1*a* senses the misfire of cylinders #1, #3, #5 and #7, whereas the internal combustion engine misfire sensing circuit 1*b* senses the misfire of cylinders #2, #4, #6 and #8.

The known internal combustion engine misfire sensing circuit has a problem that since periods during which an ion current flows overlap in, for example, the eight-cylinder engine, it cannot sense misfire.

To cope with this problem, the eight-cylinder engine needs two sets of internal combustion engine misfire sensing circuits, whereby a problem arises in that a plurality of signal lines are necessary to sense an ion current or misfire. Accordingly, miniaturization of an internal combustion engine misfire sensing circuit is prevented.

SUMMARY OF THE INVENTION

The present invention may be utilized for solving the above described problems, and an object of the invention is to provide an internal combustion engine misfire sensing circuit, whereby misfire can be sensed even in an internal combustion engine having many cylinders, the number of parts can be reduced and the miniaturization of a device can be achieved accordingly.

An internal combustion engine misfire sensing circuit according to the present invention comprises ion current sensing means for sensing an ion current in the combustion chamber of an internal combustion engine, current/voltage conversion means for converting the sensed ion current into a voltage, and waveform shaping means for shaping the waveform of an output from said current/voltage conversion means and outputting a misfire sensing signal of a cylinder based on the sensed ion current during a period of time from the sensing of the ion current of sense cylinder to the ignition of the next cylinder.

Consequently, misfire can be sensed even in an internal combustion engine having many cylinders, the number of parts can be reduced and the area of circuits can be reduced accordingly.

DESCRIPTION OF PREFERRED EMBODIMENT

Embodiment 1

Figure 1:
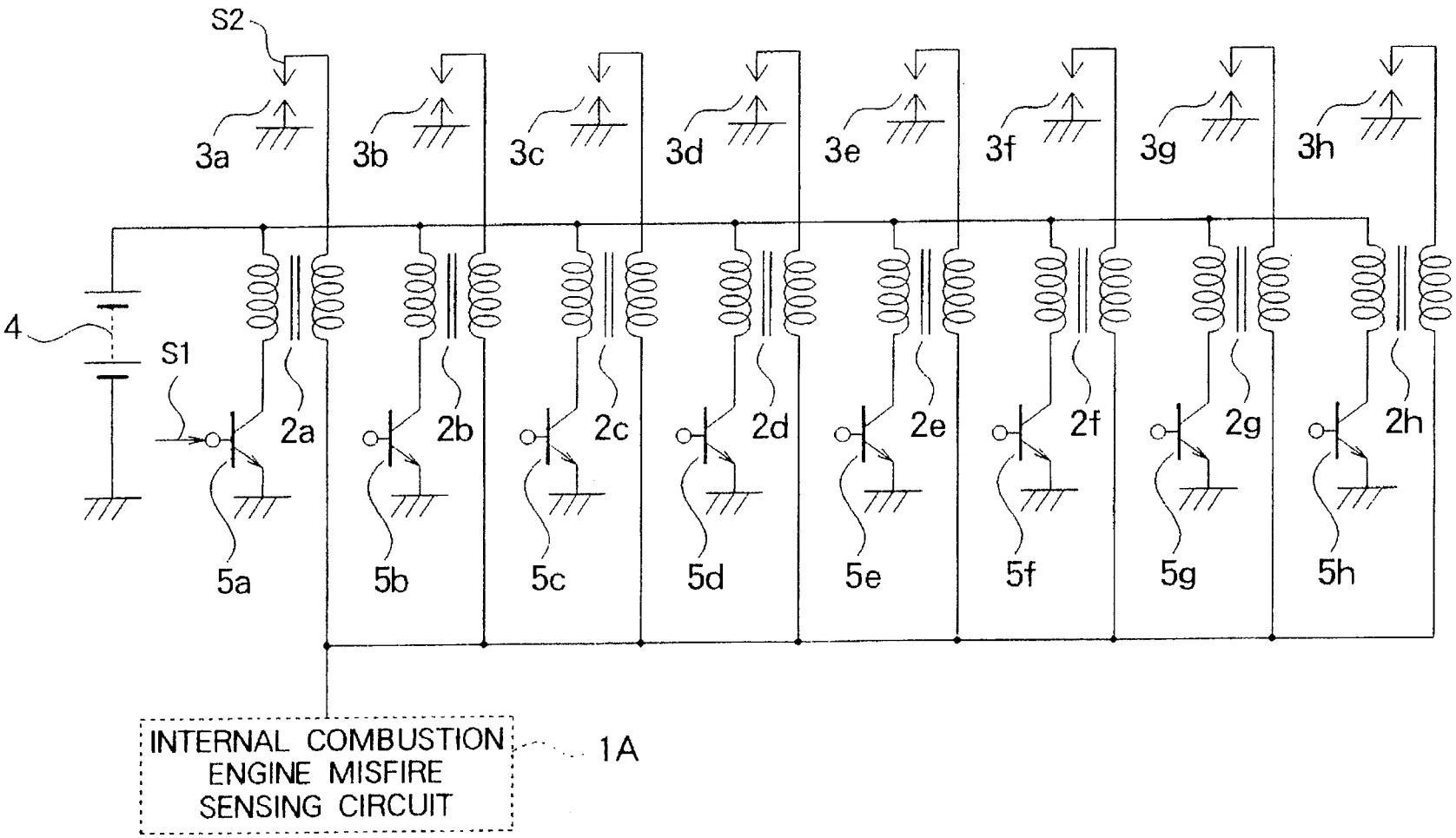
FIG. 1 is a view showing an arrangement of an internal combustion engine according to a first embodiment of the present invention.
Figure 2:
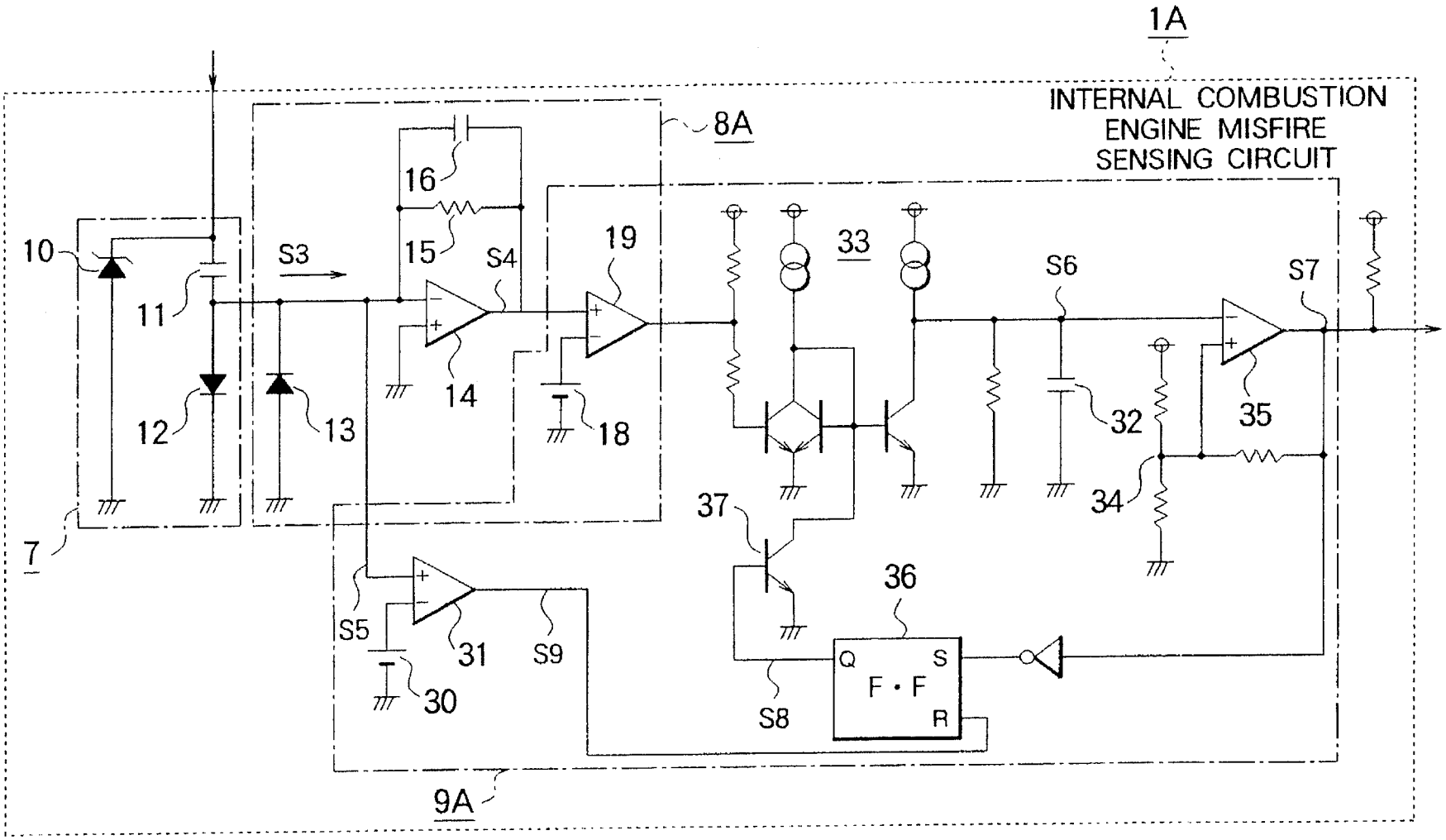
FIG. 2 is a diagram showing a circuit arrangement of the first embodiment of the present invention.
Figure 3:
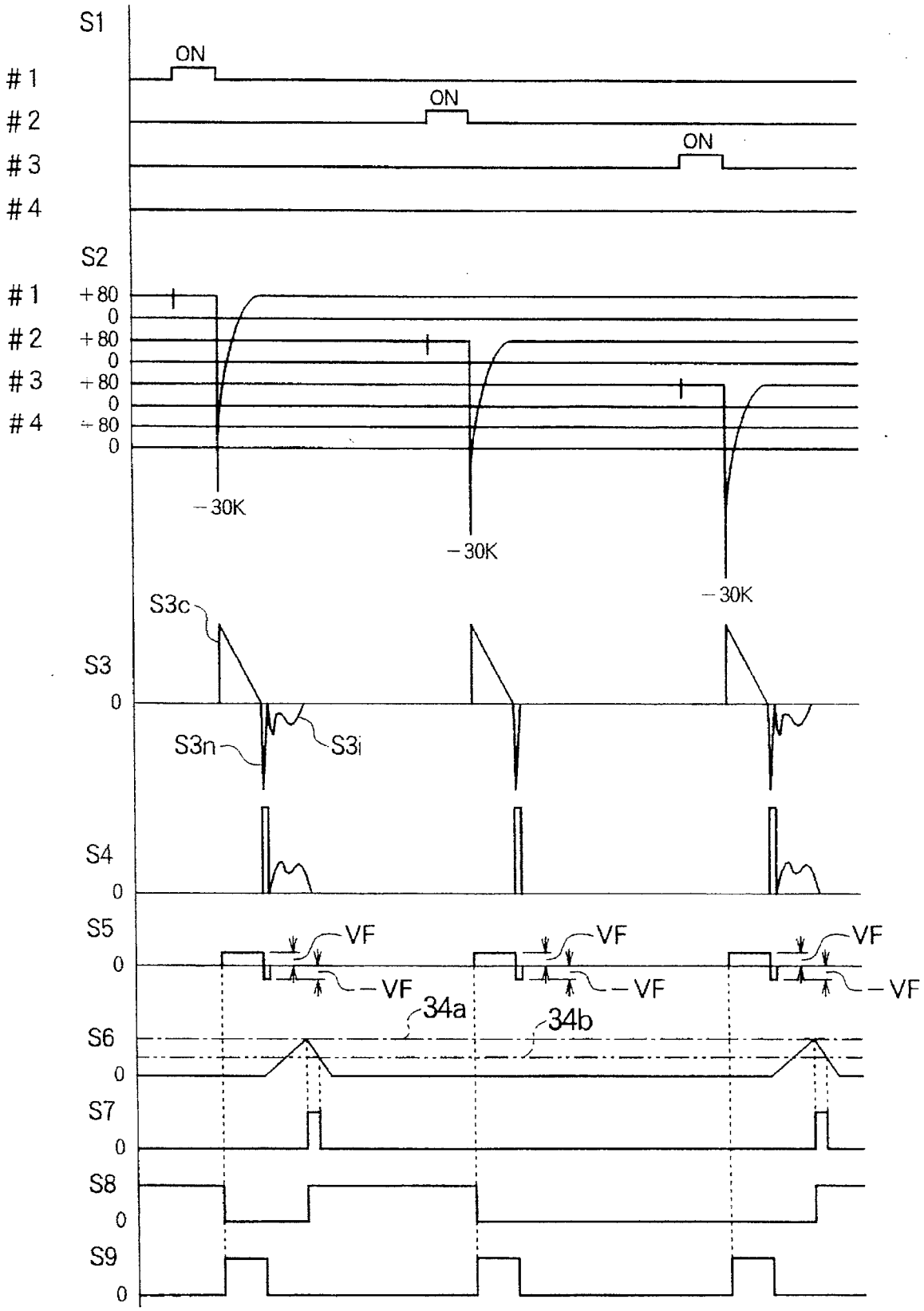
FIG. 3 is a timing chart showing operation of the first embodiment of the present invention.
Figure 4:
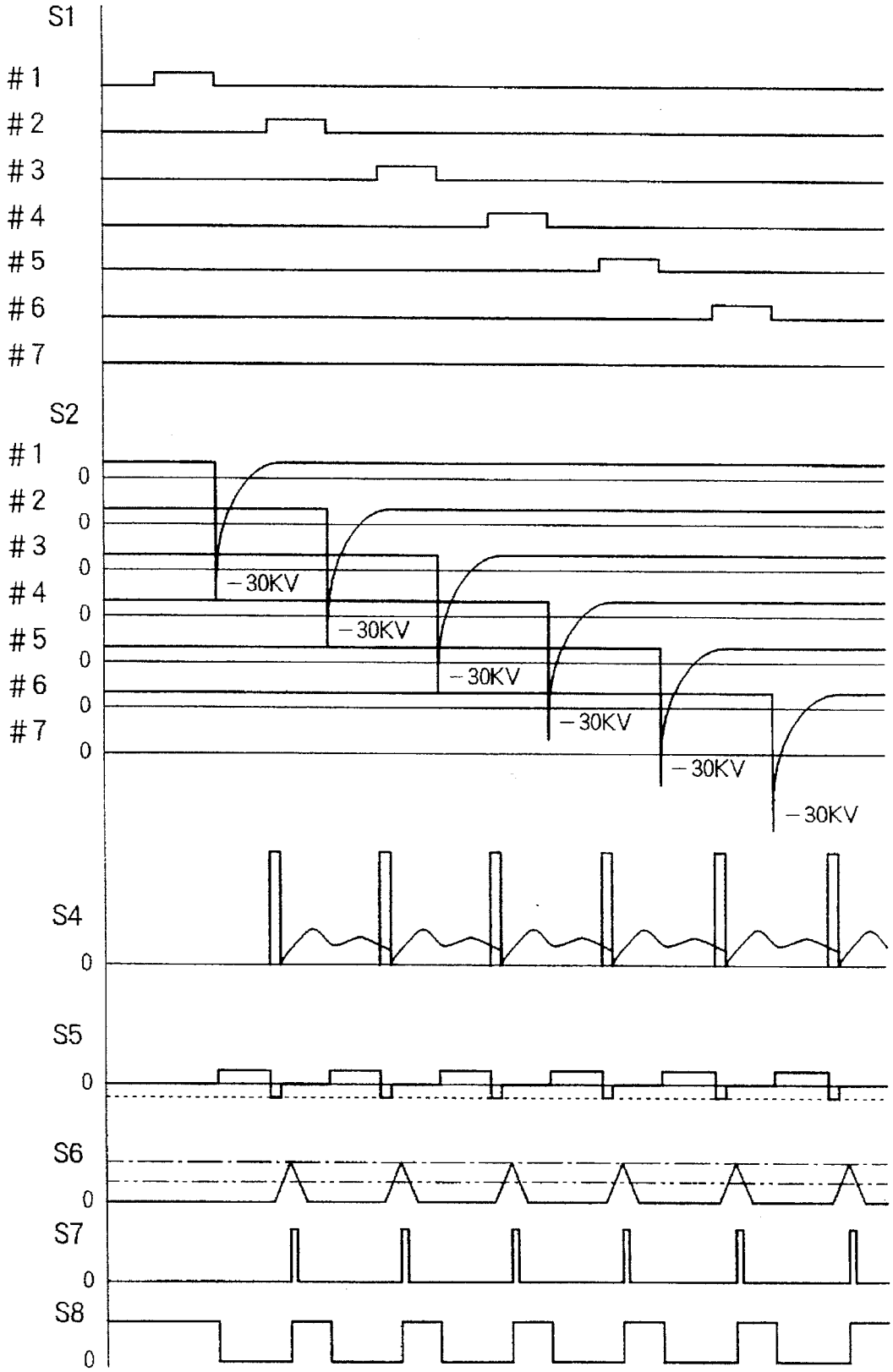
FIG. 4 is a timing chart showing operation of the first embodiment of the present invention.
Figure 5:
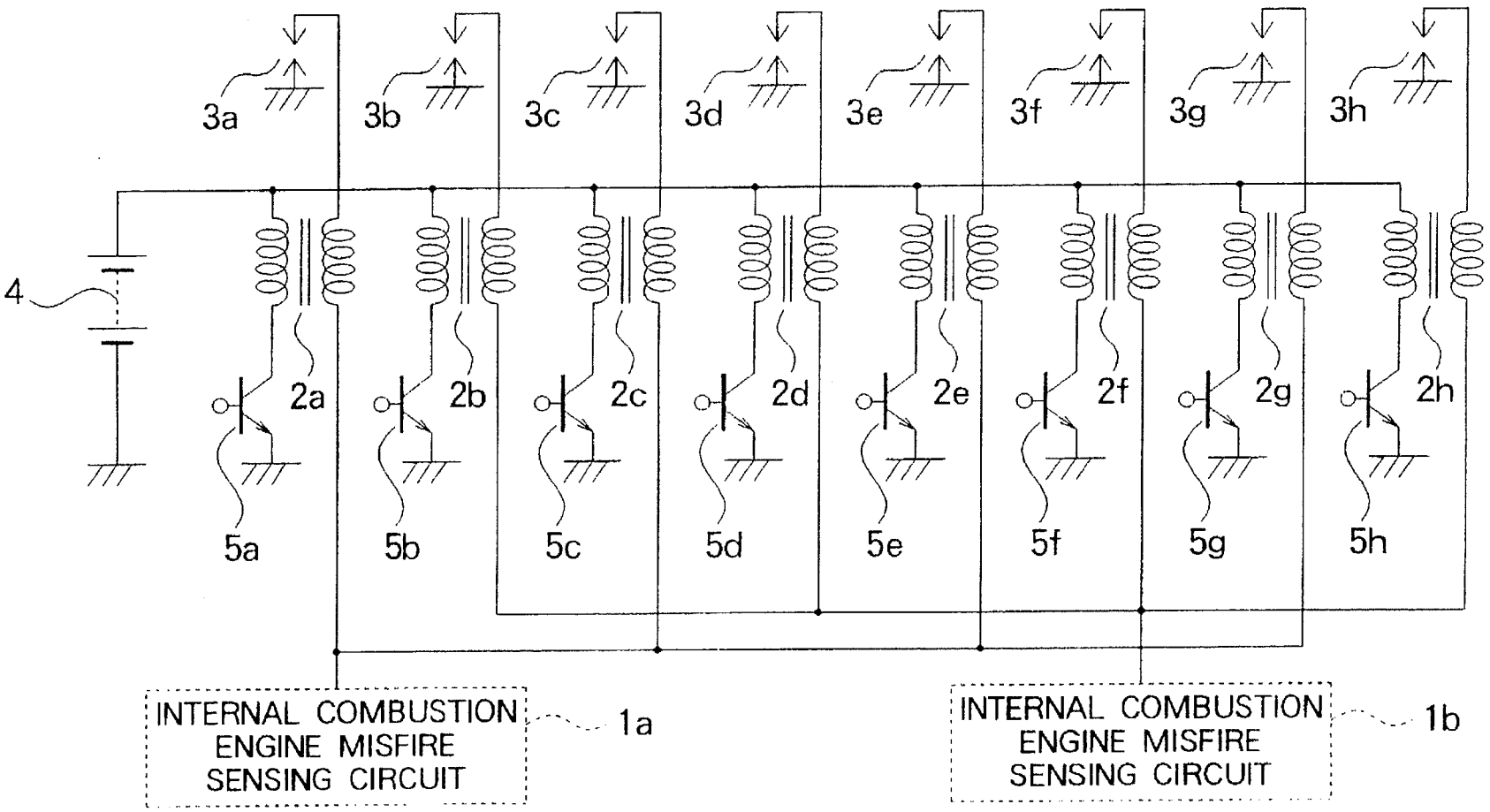
FIG. 5 is a view showing an arrangement of a known internal combustion engine described in a not yet published earlier application.
Figure 6:
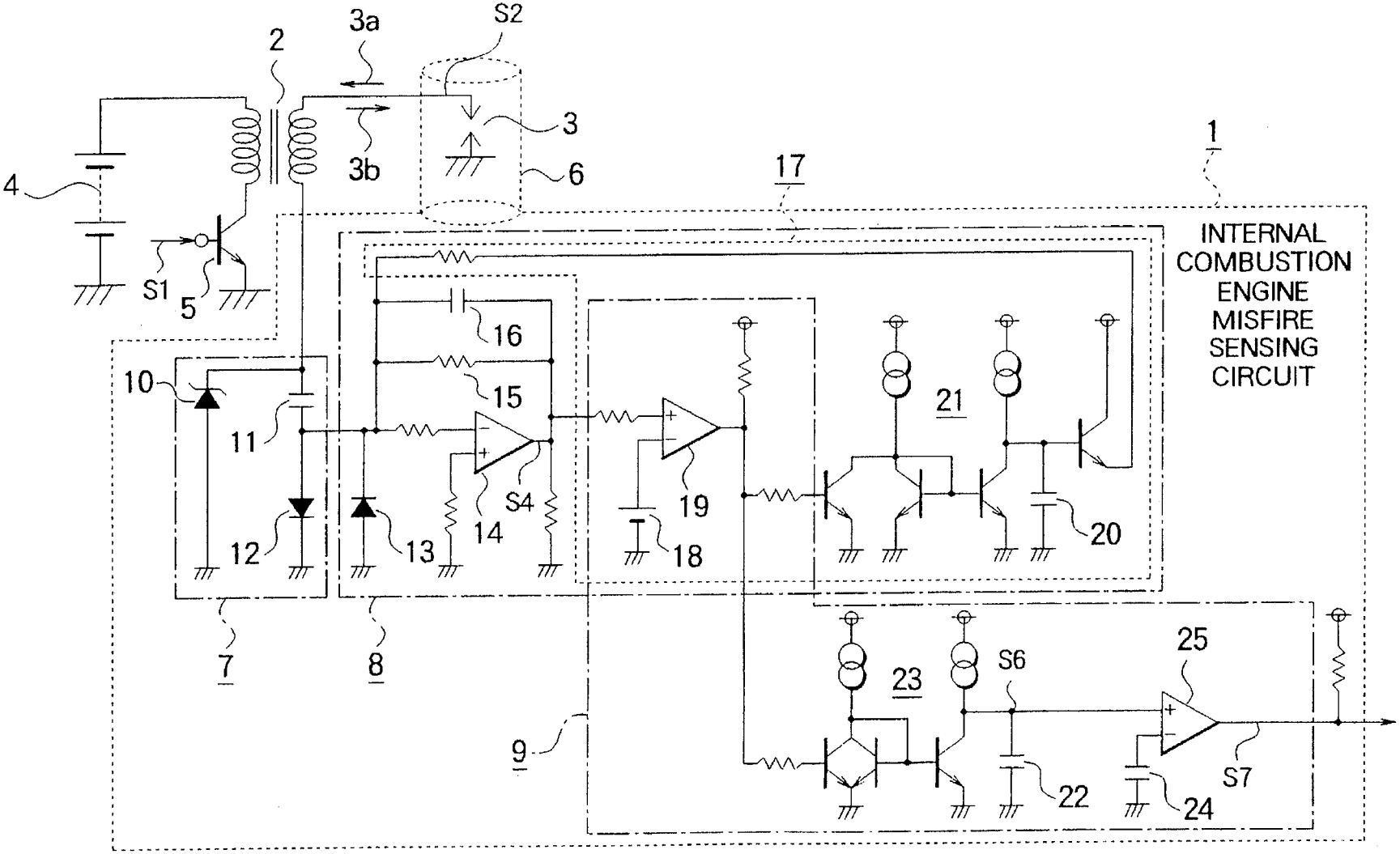
FIG. 6 is a diagram showing a circuit arrangement of a known internal combustion engine misfire sensing circuit described in the not yet published earlier application.
Figure 7:
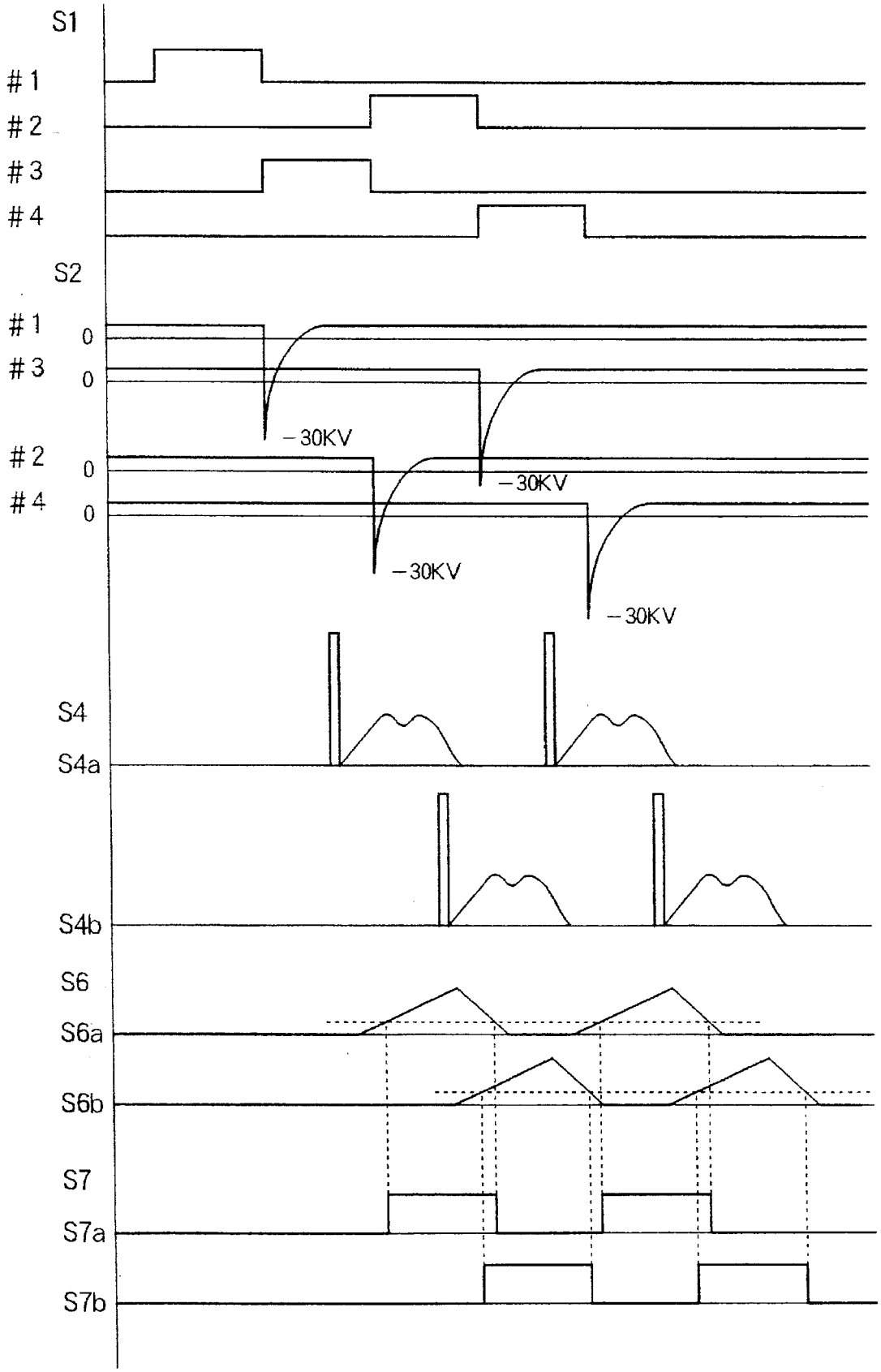
FIG. 7 is a timing chart showing operation of the known internal combustion engine misfire sensing circuit described in the not yet published earlier application.

A first embodiment of the present invention will be described below with reference to FIG. 1, FIG. 2, FIG. 3 and FIG. 4. FIG. 1 is a view showing an arrangement of an internal combustion engine according to a first embodiment of the present invention and FIG. 2 is a diagram showing an arrangement of an internal combustion engine misfire sensing circuit according to the first embodiment of the present invention. Further, FIG. 3 and FIG. 4 are timing charts showing operation of the first embodiment, although they do not show operation of all the cylinders (eight cylinders). Note, FIG. 3 shows the case wherein a cylinder #2 is in the state of misfire. In the respective drawings, the same numerals denote the same or corresponding parts.

In FIG. 1, an internal combustion engine misfire sensing circuit 1A is connected to the secondary coils of ignitions coils 2*a*–2*h* for cylinders #1–#8.

In FIG. 2, the internal combustion engine misfire sensing circuit 1A includes an ion current sensing circuit 7 for sensing an ion current, a current/voltage conversion circuit 8A for converting the ion current into a voltage, and a waveform shaping circuit 9A for shaping the waveform of a voltage output from the current/voltage conversion circuit 8A.

In FIG. 2, the ion current sensing circuit 7 comprises a capacitor (first capacitor) 11 connected to the positive pole of the secondary coil of each ignition coil, a diode (first diode) 12 connected between the low voltage side of the capacitor 11 and the ground with the anode thereof connected to the capacitor 11, and a zener diode 10 connected between the positive pole of the secondary coil of each of ignition coils 2 (2*a*–2*h*) and ground for determining a voltage to be charged in the capacitor 11.

In FIG. 2, the current/voltage conversion circuit 8A comprises a diode (second diode) 13 having an anode connected to the ground and a cathode connected to the point where the low potential electrode of the capacitor 11 is connected to the anode of the diode 12, an operational amplifier 14 having an inverting input terminal connected to the anode of the diode 12 and a non-inverting input terminal connected to ground, a feedback resistor 15 connected between the inverting input terminal of the operational amplifier 14 and the output terminal thereof, a capacitor (second capacitor) 16 connected between the inverting input terminal of the operational amplifier 14 and the output terminal thereof for removing high frequency noise and a comparator (first comparator) 19 for comparing a voltage output from the operational amplifier 14 with a threshold voltage of a reference voltage source (first reference voltage source) 18.

Further, in FIG. 2, the waveform shaping circuit 9A comprises a comparator (third comparator) 31 having a non-inverting input terminal connected to the point where the capacitor 11 is connected to the diode 12 for comparing a voltage at the connecting point with a threshold voltage of a reference voltage source (third reference voltage source) 30, the comparator 19 for comparing the voltage output from the operational amplifier 14 with the threshold voltage of the reference voltage source 18, a capacitor (third capacitor) 32, a constant current charging/discharging circuit 33 for the capacitor 32, a comparator (second comparator) 35 for comparing a voltage of the capacitor 32 with two threshold voltages at a voltage dividing point 34, a flipflop circuit (F/F) 36 having an S terminal connected to the output terminal of the comparator 35 through an invertor and an R terminal connected to the output terminal of the comparator 31, and a transistor 37 having a base connected to the Q terminal of the flipflop circuit 36, a collector connected to the constant current charging/discharging circuit 33 and an emitter connected to the ground.

Note, a filter circuit comprises the capacitor 32, the constant current charging/discharging circuit 33 and the comparator 35 to filter a leak current. The comparator 19 is shared by the current/voltage conversion circuit 8A and the waveform shaping circuit 9A. Further, a capacitor charging/discharging circuit comprises the comparator 31, the constant current charging/discharging circuit 33, flipflop circuit 36 and the transistor 37.

Next, operation of the first embodiment 1 will be described. When a base voltage S1 of each of transistors 5 (5*a*–5*h*) is switched from an ON state to an OFF state as shown in S1 of FIG. 3, a primary current of each of the ignition coils 2 (2*a*–2*h*) is abruptly reduced and a high voltage S2 of about −30 kV is generated by a back electromotive force of the coil as shown in S2 of FIG. 3.

The ion current sensing circuit 7 accumulates an electric charge in the capacitor 11, making use of energy generated at the time of ignition. Then, the ion current sensing circuit 7 senses a coil current S3 containing an ion current S3*i* (a direction flowing to the ion current sensing circuit 7 is assumed to be a positive side) immediately after the occurrence of the ignition by a voltage supplied from the capacitor 11 as shown in S3 of FIG. 3. Note, in S3 of FIG. 3, the coil current S3 contains a current component S3*c* flowing in the coil, a noise component S3*n* and the intrinsic ion current component S3*i* of 3 μA–150 μA.

Next, as shown in S4 of FIG. 3, the current/voltage conversion circuit 8A converts the coil current S3 through the operational amplifier 14 and outputs the same as an output voltage S4. When the output voltage S4 is boosted and exceeds the threshold voltage of the reference voltage source 18, since an output from the comparator 19 is made to a high level, the capacitor 32 of the waveform shaping circuit 9A is charged and its voltage S6 is boosted. When a signal S8 is made to a high level, the transistor 37 is operated and the constant current charging/discharging circuit 33 causes the capacitor 32 to start discharging, and thus the voltage S6 of the capacitor 32 is lowered.

When the voltage S6 of the capacitor 32 exceeds a first threshold voltage 34*a* of the voltage dividing point 34, an output S7 of the comparator 35 is made to a high level as shown in S7 of FIG. 3. At the time, an output S8 of the Q terminal of the flipflop circuit 36 is made to a high level as shown in S8 of FIG. 3 and the output S8 is kept to the high level until the occurrence of the next ignition. More specifically, a voltage S5 (VF: forward voltage) corresponding to the coil current S3 is generated by the diode 13 as shown in S5 of FIG. 3. When the voltage S5 exceeds the threshold voltage of the reference voltage source 30, the comparator 31 outputs a signal S9 and the output S8 is switched to a low level in response to the signal S9 as shown in S9 of FIG. 3.

Consequently, the capacitor 32 is not charged during a period in which the output S8 is set to the high level even if an output from the comparator is made to a high level. Further, a signal S7 as a misfire sensing signal having a very short pulse width can be generated after the ion current is sensed. Therefore, even if the number of cylinders is increased and an ignition cycle is shortened, a misfire sensing signal does not overlap the misfire sensing signal of other cylinder as shown in FIG. 4.

In the not yet published earlier application, although the two internal combustion engine misfire sensing circuits 1*a* and 1*b* are connected to each other in series and they output misfire sensing signals, respectively, the misfire sensing signals can be put together in a single misfire sensing signal in the first embodiment.

According to the first embodiment, the waveform shaping circuit 9A is arranged to charge the capacitor 32 up to the first threshold voltage 34*a* and the capacitor 32 starts discharging from the time, a misfire sensing signal can be generated for a predetermined period of time after an ion current is sensed, so that the above misfire sensing signals can be put together in a single misfire sensing signal, by which the number of parts can be reduced and a less expensive small circuit can be provided.

More specifically, when misfire of eight-cylinders engine is to be sensed, although two sensing circuits are conventionally needed, the first embodiment needs only one sensing circuit, thus the area of IC is reduced to one half that of known IC. Note, the area of a known sensing circuit is substantially the same as that of the sensing circuit of the first embodiment.

What is claimed is:

1. An internal combustion engine misfire sensing circuit comprising:

an ion current sensing circuit for sensing an ion current generated by ignition in respective cylinders of an internal combustion engine;

a current/voltage conversion circuit for converting the ion current sensed by said ion sensing circuit into a voltage having a waveform; and a waveform shaping circuit for shaping the waveform of the voltage from said current/voltage conversion circuit and for outputting a misfire sensing signal for a cylinder upon sensing of an ion current for that cylinder, the misfire sensing signal being output only during a time period extending from sensing of the ion current for that cylinder to ignition of another of the cylinders of the internal combustion engine.

2. The internal combustion engine misfire sensing circuit according to claim 1 wherein said ion current sensing circuit includes:

a capacitor connected to positive poles of ignition coils of the internal combustion engine;

a diode connected between a low voltage side of said capacitor and ground, said diode having an anode connected to said capacitor; and a Zener diode connected between the secondary positive poles of the ignition coils and ground for limiting a voltage for charging said capacitor.

3. An internal combustion engine misfire sensing circuit comprising:

an ion current sensing circuit for sensing an ion current generated by ignition in respective cylinders of an internal combustion engine;

a current/voltage conversion circuit for converting the ion current sensed by said ion sensing circuit into a voltage having a waveform, said current/voltage conversion circuit including:

a diode having an anode connected to ground and a cathode connected to positive poles of ignition coils of the internal combustion engine through a first capacitor;

an operational amplifier having an inverting input terminal connected to the anode of said diode and a non-inverting input terminal connected to the ground;

a feedback resistor connected between the inverting input terminal of said operational amplifier and an output terminal of said operational amplifier;

a second capacitor connected between the inverting input terminal of said operational amplifier and the output terminal of said operational amplifier for removing high frequency noise; and a comparator for comparing a voltage output from said operational amplifier with a voltage of a reference voltage source; and a waveform shaping circuit for shaping the waveform of the voltage from said current/voltage conversion circuit and for outputting a misfire sensing signal for a cylinder upon sensing of an ion current for that cylinder, the misfire sensing signal being output during a time period extending from sensing of the ion current for that cylinder to ignition of another of the cylinders of the internal combustion engine.

4. An internal combustion engine misfire sensing circuit comprising:

an ion current sensing circuit for sensing an ion current generated by ignition in respective cylinders of an internal combustion engine;

a current/voltage conversion circuit for converting the ion current sensed by said ion sensing circuit into a voltage having a waveform; and a waveform shaping circuit for shaping the waveform of the voltage from said current/voltage conversion circuit and for outputting a misfire sensing signal for a cylinder upon sensing of an ion current for that cylinder, the misfire sensing signal being output during a time period extending from sensing of the ion current for that cylinder to ignition of another of the cylinders of the internal combustion engine, said waveform shaping circuit including:

a first capacitor charged by the voltage output by said current/voltage conversion circuit;

a first comparator for comparing a voltage of said first capacitor with first and second reference voltages for outputting the misfire sensing signal; and a capacitor charging/discharging circuit for charging said first capacitor in response to an increase in the voltage output by said current/voltage conversion circuit and for discharging said first capacitor based on the misfire sensing signal.

5. The internal combustion engine misfire sensing circuit according to claim 4 wherein said capacitor charging/discharging circuit includes:

a second comparator having a non-inverting input terminal connected to positive poles of ignition coils of the internal combustion engine for comparing a voltage at the positive poles of the ignition coils with a voltage of a first reference voltage;

a constant current charging/discharging circuit for charging and discharging said first capacitor;

a flip-flop circuit having a set terminal connected to an output terminal of said first comparator through an inverter and a reset terminal connected to an output terminal of said second comparator; and a transistor having a base connected to a Q terminal of said flip-flop circuit, a collector connected to said constant current charging/discharging circuit, and an emitter connected to ground.

6. The internal combustion engine misfire sensing circuit according to claim 5 wherein said ion current sensing circuit includes:

a second capacitor connected to the positive poles of the ignition coils of the internal combustion engine;

a first diode connected between a low voltage side of said second capacitor and the ground, said first diode having an anode connected to said second capacitor; and a Zener diode connected between the positive poles of the ignition coils and the ground for limiting a voltage for charging said second capacitor.

7. The internal combustion engine misfire sensing circuit according to claim 6 wherein said current/voltage conversion means includes:

a second diode having an anode connected to the ground and a cathode connected to the low voltage side of said second capacitor;

an operational amplifier having an inverting input terminal connected to the anode of said first diode and a non-inverting input terminal connected to the ground;

a feedback resistor connected between the inverting input terminal of said operational amplifier and an output terminal of said operational amplifier;

a third capacitor connected between the inverting input terminal of said operational amplifier and the output terminal of said operational amplifier for removing high frequency noise; and a third comparator for comparing a voltage output from said operational amplifier with a voltage of a second reference voltage.

* * * * *